United States Patent [19]

Johnson et al.

[11] 4,232,816

[45] Nov. 11, 1980

[54] CLAMSHELL TYPE CARTON

[75] Inventors: Fred J. Johnson, Long Beach, Calif.; Richard L. Bell, Glenmoore, Pa.

[73] Assignee: Container Corporation of America, Chicago, Ill.

[21] Appl. No.: 21,256

[22] Filed: Mar. 16, 1979

[51] Int. Cl.[3] ..... B65D 5/26; B65D 05/66

[52] U.S. Cl. ..... 229/33; 229/36

[58] Field of Search ..... 229/33, 36, 31, 34 R

[56] References Cited

U.S. PATENT DOCUMENTS

| | | | |
|---|---|---|---|
| 3,019,958 | 2/1962 | Asmam et al. | 229/36 X |
| 3,038,650 | 6/1962 | Asmam | 229/33 |
| 3,146,933 | 9/1964 | Moore | 229/33 X |
| 3,825,169 | 7/1974 | Meyers | 229/34 R X |
| 3,968,922 | 7/1976 | Ruud | 229/33 |

*Primary Examiner*—Davis T. Moorhead

*Attorney, Agent, or Firm*—Richard W. Carpenter

[57] ABSTRACT

A carton has a cover in the shape of a truncated pyramid and a tray of like shape. The cover and the tray each have a wall joined along a common fold line. The side walls of the cover are dimensioned to extend beyond the side walls of the tray so that the edges of the side walls of the tray contact the interior faces of corresponding side walls of the cover, when the cover is closed onto the tray.

2 Claims, 8 Drawing Figures

CLAMSHELL TYPE CARTON

BACKGROUND OF THE INVENTION

The structure of the present invention finds special use in the fast food field where sandwiches or other comestibles are quickly packaged for either in house consumption or for carry out trade.

SUMMARY OF THE INVENTION

The carton according to the present invention is formed from a cut and scored blank which can be partly set up and shipped in nested condition comprised of a joined tray and cover, each in the form of a truncated pyramid. The tray portion is readily filled with a comestible, such as a sandwich, and covered with a cover having its side walls in an overlapping relationship with the side walls of the tray. The front walls of the tray and cover are provided with latching means for locking the cover to the tray. The structure is such as to provide a completely closed tray and cover with the contents protected against unwarranted prying without opening the carton in proper manner.

THE DRAWINGS

Figure 1:
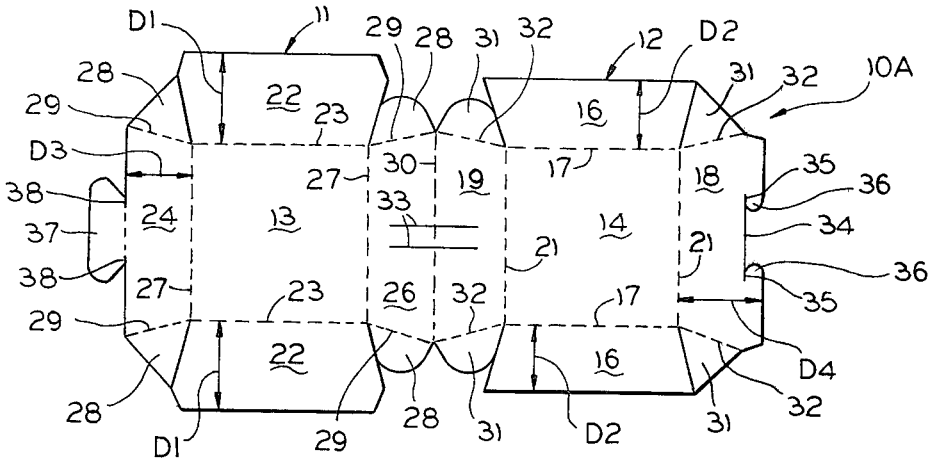
FIG. 1 is a plan view of cut and scored paperboard blank for forming a carton according to one embodiment of the present invention.

A carton according to one embodiment of the present invention is referred to generally by the reference numeral 10 and is formed from a cut and scored blank 10A of paperboard, or the like.

Figure 2:
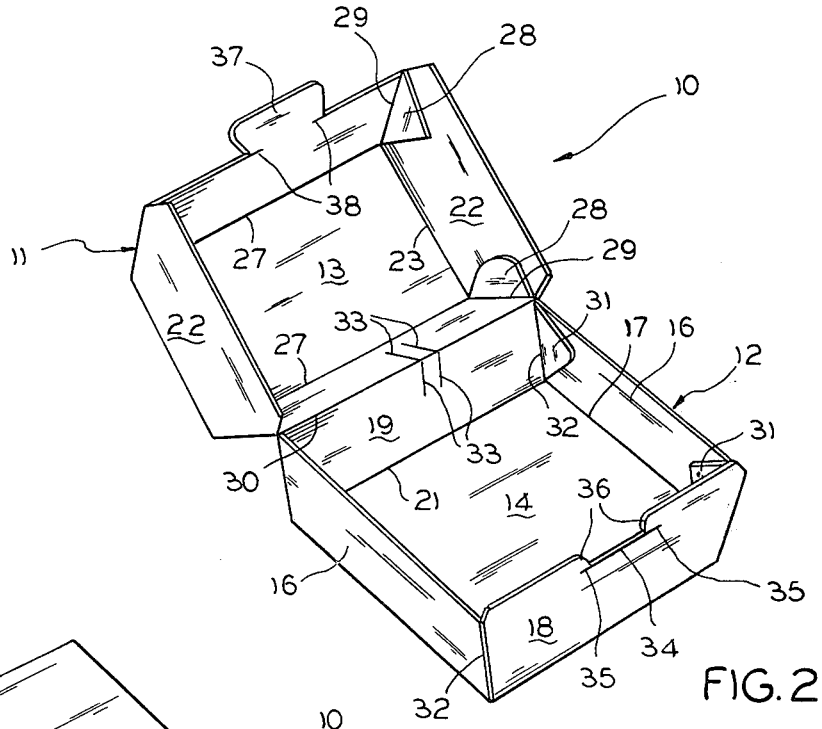
FIG. 2 is an isometric view showing the blank of FIG. 1 set up as a carton ready for loading.
Figure 3:
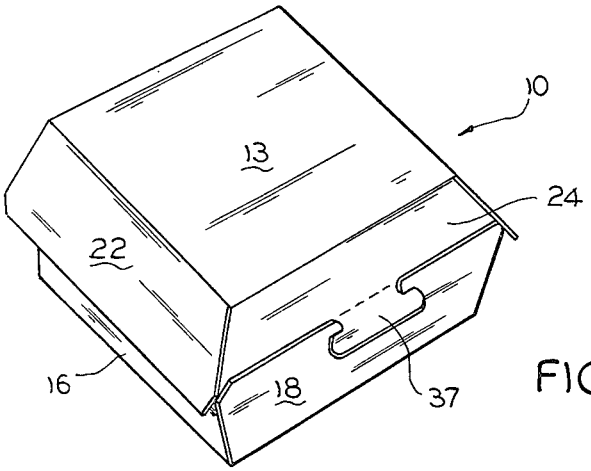
FIG. 3 shows the carton of FIG. 2 in closed condition.

Blank 10A is adapted to form a cover 11 and a tray 12, each being in the shape of a truncated pyramid as seen in FIGS. 2 and 3.

The cover 11 comprises a central panel 13 having rectangular configuration while a tray 12 includes a similar central panel 14 also of rectangular form.

The central panel 14 forming part of the tray 12 has a pair of opposed side wall panels 16 foldable with respect thereto along opposed fold lines 17, each wall panel 16 having a shape of a trapezoid with the minor base thereof connected to the central panel 14 at the fold line 17.

A front wall 18 and a back wall 19 are each foldably connected to the central panel 16 along opposed fold lines 21.

The central panel 13 forming a part of the cover 11 has opposed side wall panels 22 foldable with respect thereto along opposed fold lines 23, each wall panel 22 being in the form of a trapezoid with the minor base thereof connected to the central panel 13 along the fold line 23.

A cover front wall panel 24 is foldably connected to the central panel 13 along a fold line 27, and a rear wall panel 26 is also connected to panel 13 by a like fold line 27.

The rear wall panels 19 and 26 are connected along a common fold line 30.

It should be noted that the front and rear panels forming the tray 12 and the cover 11 are trapezoidal in shape with their minor bases foldably connected at the fold lines 21 and 27.

In order to form the cover 11 in the shape of a truncated pyramid, the front wall panel 24 and the rear wall panel 26 are provided with glue tabs 28 located at the ends thereof, these being glued to the ends of the side wall panels 22. Each glue tab 28 is connected at a fold line 29 inclined with respect to the fold line 23 and marking the ends of the wall 24. The ends of the side walls 22 are inclined with respect to the fold lines 27, and the fold lines 29 of the glue tabs 28 are caused to be aligned with the ends of the side wall panels 22, so that a gluing operation produces a cover 11 having the form of a truncated pyramid.

In like fashion, the tray 12 is formed as a truncated pyramid, and the front wall panel 18 of the tray 12 and the rear wall panel 19 thereof are also provided at their ends with glue tabs 31 connected thereat along score lines 32 inclined with respect to the fold line 17 and defining the trapezoid shape of the panels 18 and 19.

The glue tabs 31 are glued to the ends of the trapezoid shaped side wall panels 16 at the inclined end edges thereof, the score lines 32 being aligned with the end edges of the panels 16.

In the embodiment illustrated in FIGS. 1–3, lateral dimension $D_1$ of the side walls 22 of the cover 11 is greater than the lateral dimension $D_2$ of the side walls 16 of the tray 12. As best seen in FIG. 3, the side walls 22 of the cover 11 overhang the side walls 16 of the tray 12 and the edges of the walls 16 contact the inner faces of the walls 22. The dimensional relationship between $D_1$ and $D_2$ can be readily varied, as described hereinafter in connection with a discussion of the embodiment illustrated in FIGS. 7 and 8.

As described heretofore, the rear walls 19 and 26 of the tray 12 and the cover 11, respectively, are foldably joined to one another along a common fold or hinge line 30. One or more lines of weakness or slits 33 may be formed in the rear walls bisecting the hinge line 30. The slit or slits perform an important function by weakening a center portion of the rear wall hinge 30 thereby reducing a tendency of the rear walls to buckle in when the cover 11 is closed. Additionally, the slit 33 serves as a vent for the interior of the carton.

A latching structure is provided for latching the cover 11 to the tray 12 when carton 10 is loaded and includes a locking cutout portion 34 in the front wall 18 of the tray 12. Slots 35 extend from the cutout portion 34. The portion 34 includes spaced locking tabs 36.

The latching structure includes a latching tab 37 extending from the cover front wall 24, and including slits 38 which are extensions of the free edge of the cover front wall 24. The latching tab 37 is engaged with the cutout portion 34 and the slots 35 and 38 cooperate to complete the latching operation.

The full lateral dimension $D_4$ of the tray front wall 18 is greater than the lateral dimension $D_3$ of the cover front wall 24, so that upon latching, the tray front wall 18 extends over the cover front wall 24.

Figure 4:
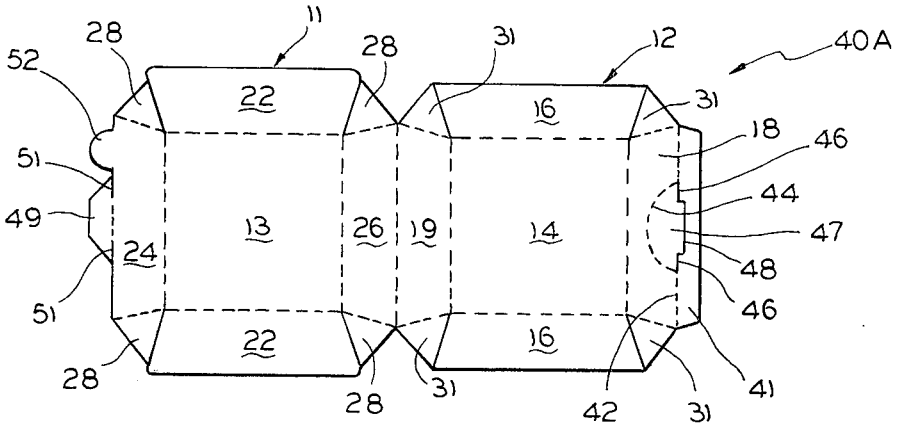
FIG. 4 is a plan view of a cut and scored blank for forming a carton according to another embodiment of the present invention.
Figure 5:
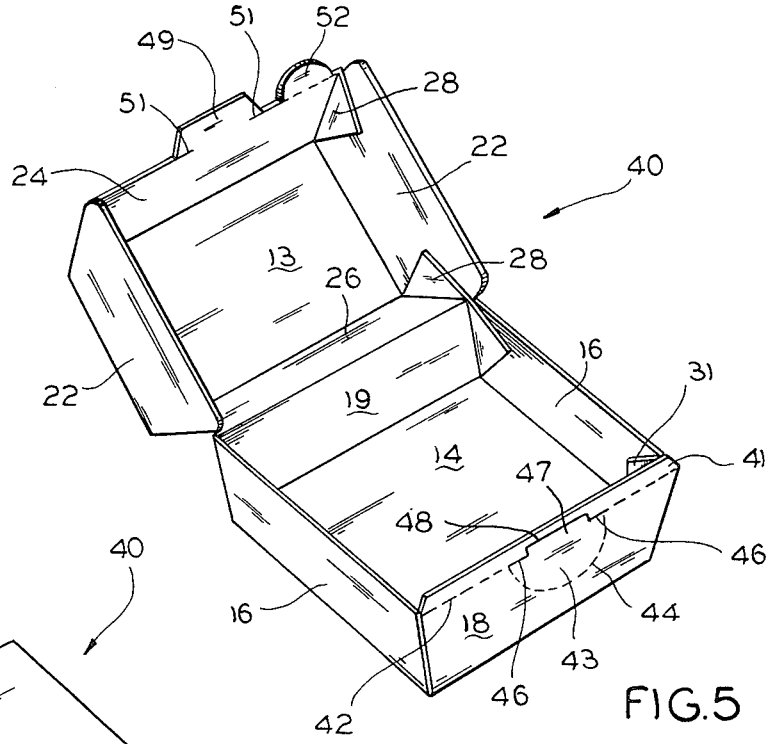
FIG. 5 is a view showing the blank of FIG. 4 set up as a carton ready for loading.
Figure 6:
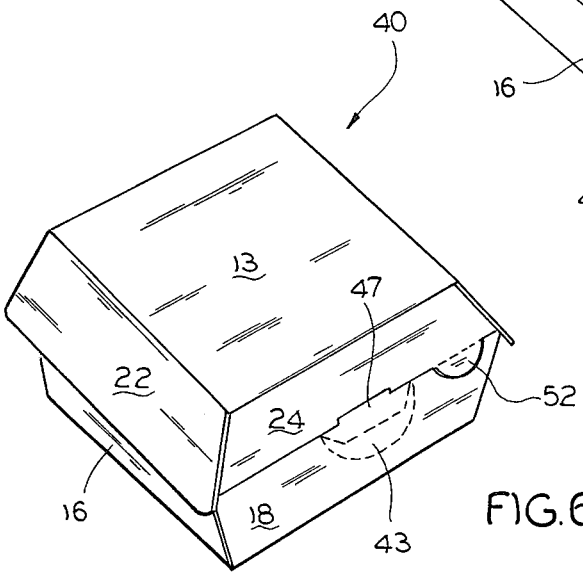
FIG. 6 shows the carton of FIG. 5 in closed condition.

Referring now to FIGS. 4 to 6 of the drawings, there is shown another embodiment of the invention referred to generally by reference numeral 40 and formed from a cut and scored blank 40A.

Details of the structure seen in FIGS. 1 to 3 and common to the structure seen in FIGS. 4 to 6 are denoted by the same reference numerals. The differences between the structures lie in the latching structure thereof and the configuration of the front walls of the cover and tray.

In FIGS. 4 to 6, the front wall 18 of the tray 12 has a flap 41 foldable along a fold line 42 with respect thereto. A locking tab 43 in the front wall 18 is defined by a semi-circular perforated line 44 terminating in diametrical slots 46 coextensive with the fold lines 42. An unlocking tab 47 lies between the slots 46 and is defined by a cut line 48 in the flap 41.

A latching tab 49 is formed as an extension of the cover front wall 24 and is flanked by slots 51 coextensive with the free edges of the front wall 24 of the cover 11. The slots 46 and 51 cooperate with the latching tab 49 and the locking tab 42 whereby the latching tab 49 enters the tray 11 behind the locking tab 43 in the front wall 18 of the tray 12.

Upon closing of the carton 40 the flap 41 moves into contact with the inner face of the cover front wall 24. The side walls 22 of the cover 11 overlap the side walls 16 of the tray 12 to prevent prying into the carton 40. A tear-off identification tab 52 may be hinged to the front wall 24 of the cover or the like.

Figure 7:
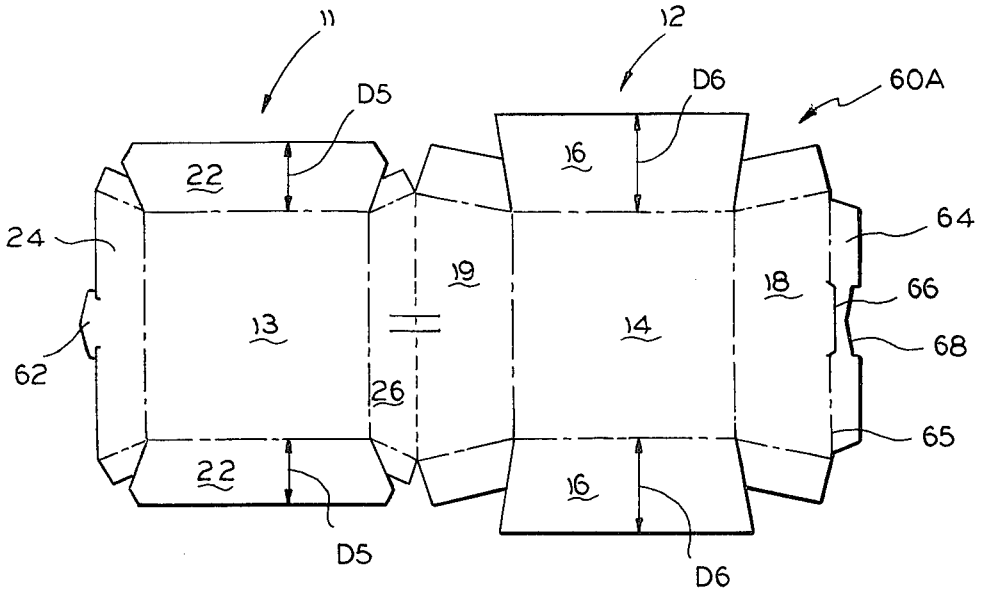
FIG. 7 is a plan view of a cut and scored blank for forming a carton according to further embodiment of the present invention.
Figure 8:
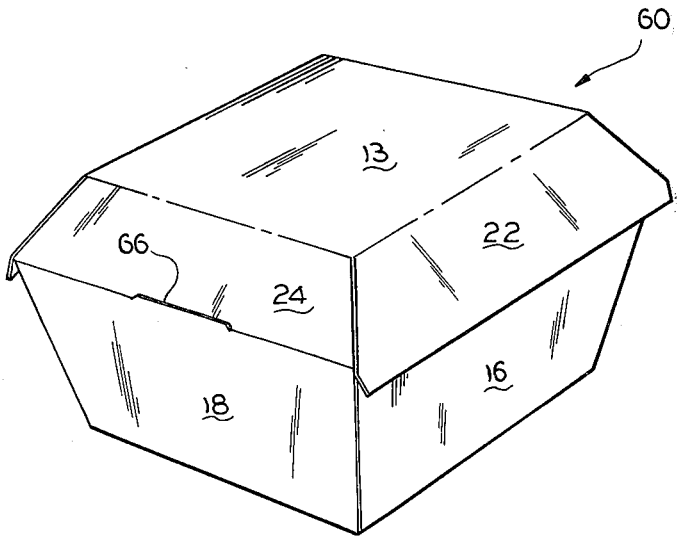
FIG. 8 shows the carton in closed condition and formed from the blank illustrated in FIG. 7.

A further embodiment of the present invention is illustrated in FIGS. 7 and 8 where a carton 60, formed from a paperboard blank 60A is disclosed. The majority of the details of the carton 60 and the blank 60A are common to the details illustrated with regard to other embodiments described hereinabove. Therefore, the elements common to two or more embodiments have been denoted by the same reference numerals.

The primary difference between the carton 60 and the carton 10 resides in the dimensional relationship of the side walls of the cover 11 and the tray 12.

As stated heretofore in conjunction with the description of the embodiment shown in FIGS. 1–3, the dimensional relationship of the side walls 16 and 22 can be varied.

FIG. 7 shows lateral dimension $D_5$ of the walls 22 of the cover 11 to be lesser than the lateral dimension $D_6$ of the walls 16 of the tray 12.

When the carton 60 is closed, as seen in FIG. 8, the walls 22 overhang the walls 16 so that the edges of the walls 16 contact the inner faces of the walls 22.

This embodiment illustrates that in order for the side walls 22 of the cover to overhang the corresponding walls 16 of the tray, it is not necessary that the walls 22 have greater lateral dimension than the lateral dimension of the side walls 16.

It is to be noted that the embodiment shown in FIGS. 7 and 8 has a different locking arrangement, as compared with the embodiment previously described.

In the present embodiment, a tab 62 extends from the cover front wall 24. The front wall 18 of the tray 12 has a flap 64 hingedly connected thereto along a fold line 65. The flap 64 is formed with a slit 66 along the fold line 65. The slit 66 receives the tab 62 of the cover front wall 24 when the carton is closed. The flap 64 is placed inside the closed carton.

A recess 68 formed in the flap 64 corresponds in its shape to the shape of the tab 62 to provide for the nesting of the blanks 60A.

We claim:

1. A carton formed from a cut and scored blank of paperboard or the like comprising:

(a) a cover of truncated pyramid configuration and a tray of like configuration hingedly joined along a fold line common to said cover and said tray;

(b) said tray and said cover each having:

(i) a central panel of generally rectangular form;

(ii) side, front and rear walls foldably connected to each central panel;

(iii) at least two of said walls positioned opposite each other having the shape of a trapezoid with the minor base thereof connected to its corresponding central panel;

(c) corresponding walls of said tray and said cover having said trapezoidal shape being provided with flaps foldably connected at inclined fold lines at the ends of said walls;

(d) each of said flaps being secured to an adjacent walls;

(e) the side walls of said cover extending beyond the side walls of said tray so that the cover overlies the tray with the free edges of said side walls of said tray being in contact with the interior faces of the corresponding side walls of said cover thereby providing a gap for escape of moisture from the interior of the carton.

2. A container according to claim 1, wherein the rear walls of said cover and tray have a line of weakness extending normal to said fold line common to said rear walls.

* * * * *

Disclaimer 4,232,816.—*Fred J. Johnson,* Long Beach, Calif. and *Richard L. Bell,* Glenmoore, Pa. CLAMSHELL TYPE CARTON. Patent dated Nov. 11, 1980. Disclaimer filed Apr. 6, 1981, by the assignee, *Container Corp. of America.*

Hereby enters this disclaimer to claims 1 and 2 of said patent.

[*Official Gazette June 9, 1981.*]